United States Patent [19]

Page

[11] Patent Number: 4,605,059

[45] Date of Patent: Aug. 12, 1986

[54] HEAT EXCHANGER

[75] Inventor: Michael J. Page, Maltby, Nr. Rotherham, England

[73] Assignee: Laporte Industries Limited, London, England

[21] Appl. No.: 678,228

[22] Filed: Dec. 5, 1984

[30] Foreign Application Priority Data

Dec. 21, 1983 [GB] United Kingdom ..... 8334078

[51] Int. Cl.[4] ..... F28D 1/00

[52] U.S. Cl. ..... 165/163; 248/68.1

[58] Field of Search ..... 165/162, 163; 248/68.1

[56] References Cited

U.S. PATENT DOCUMENTS

| | | | |
|---|---|---|---|
| 2,231,462 | 2/1941 | Cobb | 165/162 X |
| 4,030,539 | 6/1977 | Stute et al. | 165/163 X |
| 4,107,410 | 8/1978 | Toekes | 165/163 X |
| 4,231,421 | 11/1980 | Eaton et al. | 248/68.1 X |
| 4,244,542 | 1/1981 | Mathews | 248/68.1 X |
| 4,272,667 | 6/1981 | Golowacz | 165/162 X |

FOREIGN PATENT DOCUMENTS

| | | | |
|---|---|---|---|
| 1312457 | 4/1973 | United Kingdom | 165/162 |

*Primary Examiner*—Albert W. Davis, Jr.
*Assistant Examiner*—Peggy A. Neils
*Attorney, Agent, or Firm*—Kane, Dalsimer, Kane, Sullivan and Kurucz

[57] ABSTRACT

The heat exchanger (1) comprises a plurality of coils ($6^1$–$6^5$) of tubing of a flexible plastics material, the coils being of cylindrical conformation and of differing diameters each coil being mounted coaxially about the coil of next smaller diameter on an array of longitudinally arranged slat members (10) lying in spaced radial planes about the coil axis. The coils may be supported on the slat members by being received within recesses (11) in the slat edges and the slat members in turn are supported in similar manner on the coil of next smaller diameter. The tubing may be clipped into the recesses, and held therein, by virtue of the tubing or the slat members, or both being made of resiliently deformable material. Suitable material is a polyolefin or a polyvinyl material suitably a polyhalocarbon material where corrosion resistance is required. In use the flow of heat exchange fluid longitudinally through the coils is preferably countercurrent to the flow of fluid over the coils.

7 Claims, 6 Drawing Figures

HEAT EXCHANGER

BACKGROUND OF THE INVENTION

1. Field of the Invention

The invention relates to heat exchangers.

2. Brief Description of the Prior Art

Coiled tube heat exchangers are widely used in the chemical and other industries to heat or cool fluids.

There has been a demand for high performance from coiled tube heat exchangers and this has resulted in very close packing of the tubing. An example of this is the "Minicoil" (Trade Mark) which is a planar coil unit of plastics tubing which may be packed face to face with other units in a suitable container. Each unit has separate inlet and outlet tube endings capable of connection to suitable manifolding, so that the coils are operable in parallel, and thence to a suitable heat exchange fluid circulation system. A further example of a heat exchanger utilising separate planar coil units of plastics tubing packed face to face is described in British Pat. No. 2017895. This heat exchanger is distinguished by having couplings for heat exchange fluid mounted on one side of the frame of the individual coil units. Due to the flexible nature of the plastics tubing both these heat exchangers employ extensive supporting frameworks for the individual planar coils or coil units.

Heat exchangers of the above described type have non-ideal heat exchange characteristics. The flow of process fluid is transverse to the plane of the coils. It is seen that the coils alter in temperature radially as the heat exchange fluid progresses through the coil. Also successive planar coils have the same inlet and outlet temperatures but as the flow of process fluid to be subjected to heat exchange, hereafter called "process fluid", progresses from coil to coil its temperature progressively approaches the temperature of the coil it is in contact with, particularly the outlet end of that coil, so that the heat exchange efficiency of successive planar coils decreases.

Heat exchangers comprising a plurality of coils of metal tubing, the coils being operative in parallel, wherein the coils are of cylindrical conformation and of differing diameters each coil being mounted co-axially about the coil of next smaller diameter, are also known.

Such heat exchangers, in use, greatly reduce variations in heat exchange efficiency. The coils of such heat exchangers, being of metallic construction, pose relatively simple support problems because of their rigidity.

SUMMARY OF THE INVENTION

According to the present invention there is provided a heat exchanger comprising a plurality of coils of tubing operative in parallel wherein the coils are of cylindrical conformation and of differing diameters, each coil being mounted co-axially about the coil of next smaller diameter characterised in that the tubing is flexible tubing of plastics material and in the arrangement for the support of the tubing. According to this invention each coil is supported on a plurality of longitudinally arranged slat members lying in spaced radial planes with respect to the coil axis. Preferably the slat members have a plurality of recesses on their outer longitudinal edges successive recesses being adapted to releasably hold successive turns of the coil therewithin. Preferably, the recesses are shaped so that their bodies fit the cross-section of the tubing and their necks are sufficiently narrower than the cross-section of the tubing to achieve, having regard to the resilience of the materials of the tubing, a deformation fit of the tubing into the recesses. It is seen that, if the slats are supported in a suitable array, the coil to be supported may be readily wound onto the outside of the array and clipped into place within the slat recesses by virtue of the tubing, or even the slats, or both, being made of a resiliently deformable material. Similarly, the coil may be equally readily unwound. Preferably the innermost plurality of outer edge recessed slats is attached to a central axially positioned frame member of cylindrical section, by winding the innermost coil onto that array so that it is supported thereon coaxially of the frame member. It is a particularly advantageous arrangement according to this invention that the coils other than the innermost may be supported on slat members which are recessed on both edges and each slat member is itself supported by the turns of the coil of next smaller diameter being held within the recesses of its innermost edges. The entire assembly is therefore supported through the innermost coil on the central frame member. The central frame member may be supported by its ends on opposing walls of the heat exchanger container.

The tubing used is sufficiently light in weight for a number of coils to be supported on a central frame member as above described. It is found that an element constructed in this fashion may be utilised satisfactorily in practice since the specific gravities of the process fluid and the heat exchange fluid are often not greatly different so that, in use, the weight to be supported need not be much greater and can be less than that of the coil as assembled. It may be necessary to take precautions to empty the coils of heat exchange fluid before empyting the heat exchange container of process fluid to avoid undue strain on the element. This problem may be alleviated, if desired, by additionally supporting the slats, for example, by using slats of a length suitable to be supported on the opposite end walls of the heat exchanger container, or by providing radial supporting struts mounted on the central frame member and attached to the free ends of the slats. Further, if the heat exchange element is positioned vertically in the heat exchanger container, the lower ends of the slats may be supported by suitable transverse members.

The heat exchange capacity of the heat exchange element provided by the invention is dependent on the number of coils, the length of the coils, the diameter of the tubing, the heat conductivity of the tubing and other factors well known to those in the art. It is an advantageous feature of this invention that the heat exchange capacity may additionally be varied merely by dissassembling the element and rewinding the coils using slats of different widths thereby controlling the radial spacing of the coils.

The heat exchange element provided herein is particularly suitable for heating or cooling corrosive process fluids such as, for example, corrosive chlorides or fluorides or materials containing them, since the whole assembly may be constructed of corrosion resistant plastics materials or coated with such materials. While it is envisaged that the tubing used in the present heat exchange element is of flexible plastics material the particular plastic selected will depend on the temperature at which the exchanger is to be operated the corrosiveness of the process fluid and the degree of resilience required. For many applications the heat exchanger will be operated in the range of about 20° C. to 90° C. for which use a number of commonly available plastics are suitable for example polyethylene polypropylene, polyvinyl chloride, or other polyolefin or polyvinyl compounds. Polyhalocarbons such as fluorinated polyolefins, for example polytetrafluoroethylene or fluorinated polyvinyl compounds such as polyvinylidene fluoride are particularly suitable where the process fluid is corrosive. The frame and slat members may be of materials selected from the same range of plastics, as may the heat exchanger container although, for the latter, plastic coated metal may be substituted or, even, an uncoated corrosion resistant metal. Of course the option of fabricating the frame member and slats of metal such as corrosion resistant steel is also open although plastics materials are preferred for cost reasons. Suitably the innermost array of slats is welded in position on the frame member.

In use it is preferred that the heat exchanger container is adapted for flow of process fluid longitudinally through the heat exchange element, and it is further preferred that the said flow is counter-current to that of the heat exchange fluid. One or more heat exchange elements may be used in a single heat exchanger container although it is preferred, to achieve efficient heat exchange, that they be arranged in parallel to one another. Preferably the heat exchange element has an elongated shape and is, preferably, at least 1.25 times, particularly preferably at least 1.5 times as long as its diameter. Suitably, the heat exchange fluid is a liquid, for example, water.

An embodiment of the present invention will now be illustrated by reference to the following drawings.

DETAILED DESCRIPTION OF THE PREFERRED EMBODIMENTS OF THE INVENTION

We now refer to the Figures in more detail.

Figure 1:
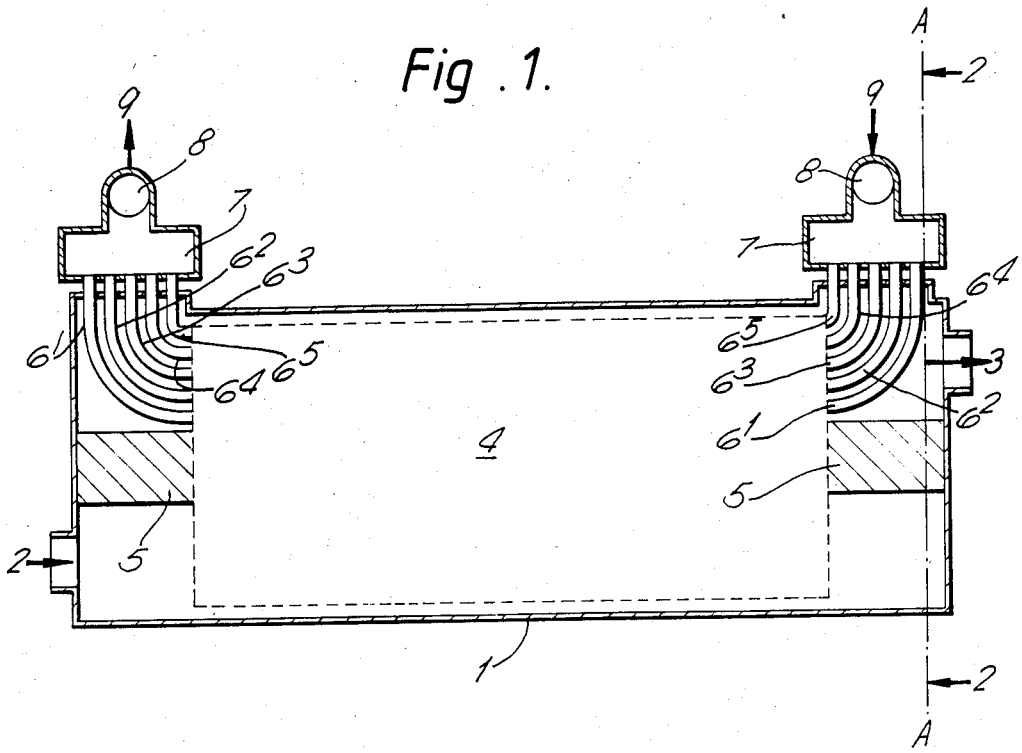
FIG. 1 is a diagramatic elevational view of the interior of a heat exchanger unit in which the rectangle bounded by broken lines indicates the positioning of the heat exchange element and the section lines indicate the wall and the element supporting frame member.
Figure 2:
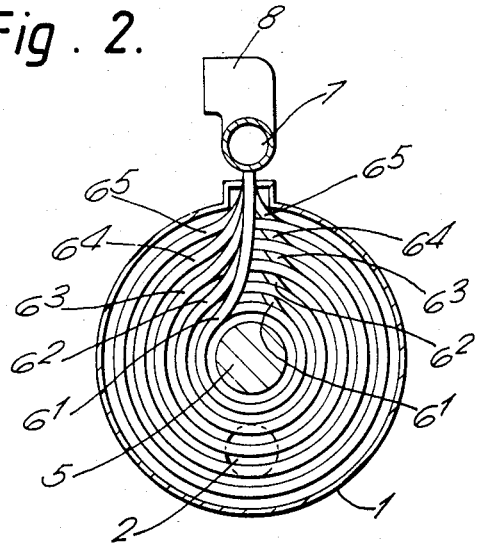
FIG. 2 is a sectional view along line AA of FIG. 1 in the direction of the arrows showing the coils but ommitting the means for supporting the coils on the frame member.

FIG. 1 shows a cylindrical casing 1 having an inlet 2 and an outlet 3 for process fluid. The space 4 is the position occupied by the heat exchange element which is carried on a frame member 5 supported on the opposing end walls of the casing. The inlet and outlet ends of five coils of polyvinylidene fluoride tubing which comprise the element are shown as $6^1$, $6^2$, $6^3$ and $6^4$ and $6^5$ in FIGS. 1 and 2, communicating with inlet and outlet manifolds 7 and heat exchange fluid supply and removal pipes 8. The arrows 9 show a preferred direction of flow of heat exchange fluid when the heat exchanger is in use, in relation to the positioning of the process fluid inlet and outlet. In FIG. 2 a single turn of each of the 5 coils is visible. These coils are supported one upon the other by means as depicted in FIGS. 3 to 6. These means have been ommitted from FIG. 2 for clarity.

Figure 3:
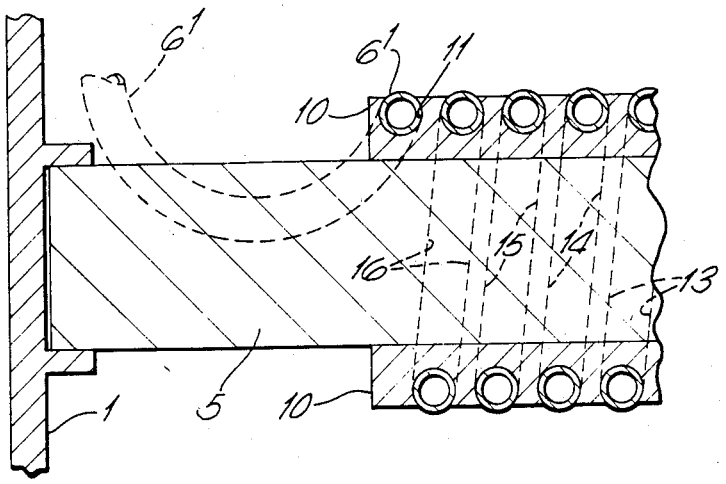
FIG. 3 is a sectional view through the centre of an end portion of the frame member showing the positioning of the end portion of the innermost coil therein.
Figure 4:
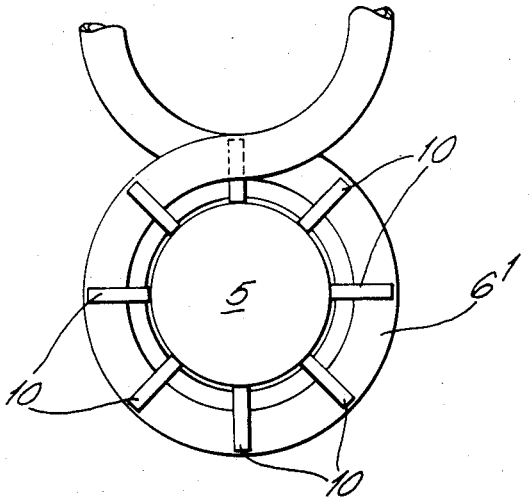
FIG. 4 is an end view of the innermost coil and frame member in the direction of the arrow in FIG. 3.

In FIG. 3 one end only of the innermost coil 6' is shown. The coil is supported on the frame member 5 by longitudinally positioned slats 10, attached by one edge to the frame member so that the central plane of the slat lies radially with respect to the frame member. The slats 10 have recesses 11 along their outer edges the mouths of the recesses being of reduced width in comparison with the bodies of the recesses. Where the tubing of the coil $6^1$ and/or the slat 10 are made of resiliently deformable material this enables the tubing to be clipped into position within the recesses and to be supported therein. As shown in FIG. 4 there is a plurality of slats positioned around the circumference of the frame member and welded thereon so that each turn of the coil is supported by a plurality of cooperating recesses. The pairs of broken lines 13, 14, 15 and 16 in FIG. 3 depict the conformation of successive turns of the coil $6^1$ as it would lie on the frame member 5.

Figure 5:
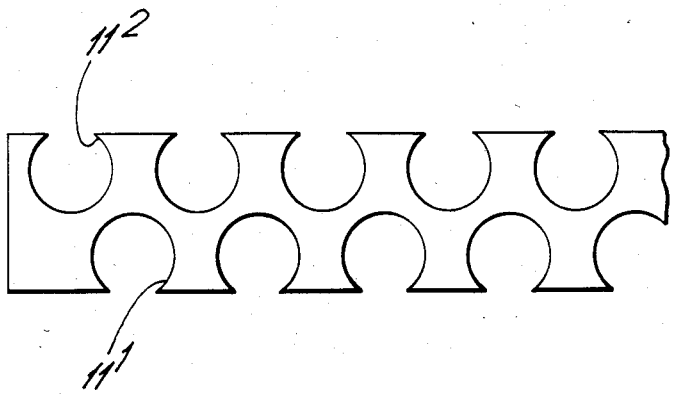
FIG. 5 is a view of the end portion of a double edge recessed slat from a position normal to the plane surface thereof.

FIG. 5 shows a slat member suitable for use to support an outer coil, e.g. coil $6^2$ on the next innermost coil, e.g. coil $6^1$. There are recesses $11^1$ on one edge and $11^2$ on the other edge of the slat so that the turns of a coil, e.g. coil $6^1$, already held in position as shown in FIGS. 3 and 4, may also be received within recesses $11^1$ and the turns of the next coil e.g. coil $6^2$, may be received within recesses $11^2$ thereby holding the two coils in spaced relationships.

Figure 6:
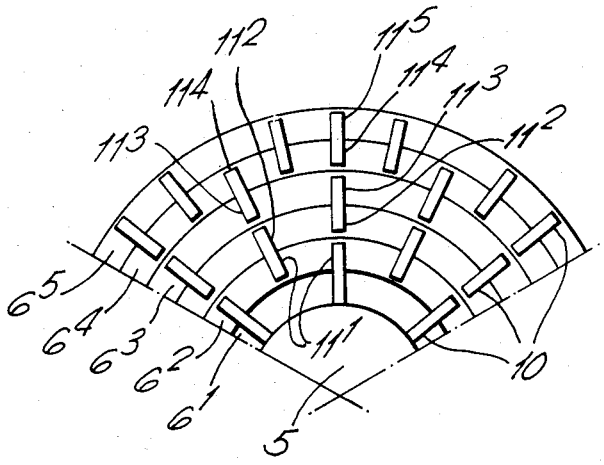
FIG. 6 is an end view of the frame member bearing multiple coils from the same direction as FIG. 4 but only a segment of the entire view being shown.

In FIG. 6 a possible arrangement of slats relative to coils $6^1$–$6^5$ is shown. Pairs of numerals $11^1$–$11^5$ show the positioning in the slats of the recesses holding the coils $6^1$–$6^5$ respectively. It is seen that the five coils are held in spaced relationship each coil being supported on the adjacent coil of next smaller diameter. In FIG. 6 the coils, due to the dimensions of the slats, are held in longitudinally overlapping arrangement so that, in use, the flow of process fluid is constrained into a sinuous path as it progresses longitudinally through the element. This contrasts with the coils depicted in FIG. 2 which are more widely spaced apart so that the entire thickness of the relevant turn of tubing in each coil is visible in on end-on view.

What is claimed is:

1. A heat exchanger element comprising a plurality of coils of tubing so arranged that a plurality of parallel flows of heat exchange fluid may be passed therethrough wherein the coils are of cylindrical conformation and of differing diameters each coil being mounted co-axially about the coil of next smaller diameter and the plurality of coils being supported on a central longitudinal frame member co-axially positioned with respect to the coil characterized in that the tubing is flexible tubing of plastics material and in that each coil is spaced outwardly with respect to the frame member from the coil of next smaller diameter by means of a plurality of slat members lying therebetween and longitudinally arranged with respect to the frame member, the slat members lying in spaced radial planes passing through and intersecting at the axis of the frame member, the innermost plurality of the slat members being attached to the frame member and the free longitudinal edges of the slats having a plurality of recesses, the recesses have mouths of a lesser dimension than the tubing comprising the turns of the coil to be capable of releasably holding turns of coil therewithin, and the coils being supported in position by successive turns thereof being inserted within said recesses.

2. A heat exchanger element as claimed in claim 1 wherein at least one of the tubing and of the slats are made of a resiliently deformable material capable of allowing the tubing to be clipped into and out of the recesses by deformation.

3. A heat exchanger element as claimed in claim 1 wherein at least one of the tubing and of the slats are made of a polymeric material selected from the group consisting of polyolefin, polyvinyl, halogenated polyolefin, and halogenated polyvinyl materials.

4. A heat exchanger element as claimed in claim 3 wherein at least one of the tubing and the slats are made of polymeric material selected from the group consisting of polyethylene, polypropylene, polyvinyl chloride, polytetrafluoroethylene and polyvinylidene chloride.

5. A heat exchanger comprising at least one element as claimed in claim 1 said element being supported within a casing by mounting the element frame member on the interior of the casing, the casing having fluid inlet an outlet means connected to the interior of the tubing constituting the coils and inlet and outlet means connected to the interior space of the casing.

6. A method of conducting heat exchange by means of a heat exchanger as claimed in claim 5 comprising passing flows of heat exchange fluid unindirectionally through the interior of the tubing constituting lack of the coils of the at least one element and passing another heat exchange fluid through the interior space of the casing outside the tubing.

7. A method as claimed in claim 6 wherein the said other heat exchange fluid is passed longitudinally along the interior of the casing with reference to the axis of the coils and counterdirectionally to the overall flow of the heat exchange fluid through the interior of the tubes.

* * * * *